United States Patent [19]

Smith et al.

[11] Patent Number: 4,704,610

[45] Date of Patent: Nov. 3, 1987

[54] EMERGENCY VEHICLE WARNING AND TRAFFIC CONTROL SYSTEM

[76] Inventors: Michel R. Smith, 752 N. Woodlawn Dr., Thousand Oaks, Calif. 91360; James Davidson, 22963 Collins St., Woodland Hills, Calif. 91367; Henry Pfister, 4455 Torrance Blvd., Torrance, Calif. 90503

[21] Appl. No.: 809,103

[22] Filed: Dec. 16, 1985

[51] Int. Cl.[4] ..... G08G 1/07

[52] U.S. Cl. ..... 340/906

[58] Field of Search ..... 340/906, 907, 902, 916, 340/933, 935

[56] References Cited

U.S. PATENT DOCUMENTS

| | | | |
|---|---|---|---|
| 2,881,409 | 4/1959 | Cook et al. | 340/906 |
| 2,981,878 | 4/1961 | Henderson | 340/906 |
| 3,020,522 | 2/1962 | Lesher | 340/906 |
| 3,114,127 | 12/1963 | Ramsey | 340/906 |
| 3,247,482 | 4/1966 | Lesher | 340/906 |
| 3,255,433 | 6/1966 | Lesher | 340/906 |
| 3,257,641 | 6/1966 | Campana et al. | 340/906 |
| 3,550,078 | 12/1970 | Long | 340/906 |
| 3,638,179 | 1/1972 | Coll et al. | 340/906 |
| 3,784,970 | 1/1974 | Simpkin | 340/906 |
| 3,881,169 | 4/1975 | Malach | 340/906 |
| 4,016,532 | 4/1977 | Rose | 340/906 |
| 4,017,825 | 4/1977 | Pichey | 340/906 |
| 4,135,144 | 1/1979 | Elmasian | 340/906 |
| 4,162,477 | 7/1979 | Munkberg | 340/906 |
| 4,223,295 | 9/1980 | Bonner et al. | 340/906 |
| 4,228,419 | 10/1980 | Anderson | 340/906 |
| 4,234,967 | 11/1980 | Henschel | 455/603 |
| 4,321,589 | 3/1982 | King | 340/906 |
| 4,443,783 | 4/1984 | Mitchell | 340/906 |
| 4,463,339 | 7/1984 | Frick et al. | 340/906 |
| 4,573,049 | 2/1986 | Obeck | 340/906 |

*Primary Examiner*—James L. Rowland
*Assistant Examiner*—Brian R. Tumm
*Attorney, Agent, or Firm*—David O'Reilly

[57] ABSTRACT

A system for providing early warning of the approach and egress of emergency vehicles in which the warning system provides a display to indicate the direction from which the emergency vehicle is approaching and in addition provides preemption control of the traffic signals at an intersection. A transmitter mounted on an emergency vehicle transmits a signal whenever it is on an emergency call which is received by infrared (I.R.) receivers positioned at an intersection to respond to the transmitted signals. The received signal is then processed by a master controller which in turn pre-empts operation of traffic signals to control traffic flow at the intersection to which the emergency vehicle is approaching. The master controller also provides an output to display signals facing approaching traffic on each road approaching the intersection which displays messages and symbols indicating the direction of the approaching emergency vehicle. Additionally, the display system indicates whether the emergency vehicle has passed through and is departing the intersection. After a predetermined interval when an emergency vehicle has passed through an intersection the display system is deactivated and the traffic signals are returned to the traffic light control system.

19 Claims, 7 Drawing Figures

EMERGENCY VEHICLE WARNING AND TRAFFIC CONTROL SYSTEM

FIELD OF THE INVENTION

The present invention relates to emergency vehicle warning systems for traffic intersections and more particularly relates to an emergency vehicle warning system which remotely operates a display indicating the direction of approaching emergency vehicles and simultaneously pre-empts the control of the traffic signals at an intersection.

BACKGROUND OF THE INVENTION

Emergency vehicles, such as fire-fighting vehicles, ambulances, and police cars, generally have the need to cross or pass through traffic signal control intersections in the shortest time possible in order to arrive at the site of an emergency in a timely manner. Even seconds can be critical to saving lives. In fact it is well known that the chances of survival of an emergency victim are considerably increased by the speed with which the emergency aid is administered.

When emergency vehicles normally proceed through an intersection they depend upon sirens, horns, bells, flashing lights or some other type of audible or visible alarm from the emergency vehicle to alert other vehicles and pedestrians in the area as to their approach Often however, due to confusion, impaired hearing, inattention, noise conditions, etc., serious accidents have occurred at these intersections due to the fact that drivers or pedestrians on the cross streets either do not perceive the audibile or visible alarms indicating the impending approach of the emergency vehicle or do not believe that the approach is sufficiently imminent and that they need to take evasive action. In some cases they will proceed through the intersection in the path of an emergency vehicle causing accidents which not only are serious enough to cause loss of life but prevent the emergency vehicles from reaching their destination. Additionally since today's highways, and city streets are becoming increasingly congested with automobile, truck, bus and pedestrian traffic, difficulty in the movement of emergency vehicles through crowded intersections is increasing. Therefore it would be an advantage if an emergency vehicle could approach an intersection with knowledge that it can safely proceed through the intersection at the greatest possible speed without danger of accident or injury. p Other systems have been proposed some few of which have been commercially successful to provide warnings at intersections. For one reason or another either because they were inadequate, complex or for other reasons these systems have not received widespread acceptance. One such system is typified for example, in U.S. Pat. No. 3,550,078, reissue 28,100, reissued Aug. 6, 1974 to W. H. Long entitled Traffic Signal Remote Control System. The invention described in this patent provides the ability of an emergency vehicle to remotely control traffic light signals so as to provide, for example, a green light for the approaching direction of an emergency vehicle and a red light for cross traffic. However, the system of the Long patent does not alert or forewarn vehicles and pedestrians approaching the intersection or in the vicinity of intersection that an emergency vehicle's approach is imminent. That device creates a dangerous situation by allowing traffic to flow at the intersection in advance of a non-forewarned approach of an emergency vehicle.

For example, while the system of this patent allows the traffic signals to be changed by the approaching vehicle, traffic along the path of the emergency vehicle can still proceed. If the operators or pedestrians are inattentive, have impaired hearing or do not hear or see any signals they can impede the progress of the emergency vehicle or even cause an accident.

It is therefore one object of the present invention to provide means by which the emergency vehicles may safely move with deliberate speed through street and highway intersections with relative safety.

Another object of the present invention is to provide a system for automatic remote pre-emption of control of traffic signals at selected intersections.

An additional object of the present invention is to provide a system by means of which operators of emergency vehicles can remotely communicate with traffic control systems which will provide the identity and direction of approach of an emergency vehicle to indicate to traffic at the intersection the direction from which the vehicle is approaching as well as the direction from which it may be departing the intersection.

Still an additional object of the present invention is to pre-empt the control of traffic signals at an intersection to change to a desired emergency signal condition in addition to providing early warning information at the intersection to vehicles and pedestrians forewarning them of the impending approach and egress of emergency vehicles.

Yet a further object of the present invention is to provide means for pre-emptive automatic control of traffic signals to halt the normal flow of all traffic through an intersection so that an emergency vehicle can speedily and safely pass through the intersection.

Still a further object of the present invention is to provide an extremely reliable and relatively inexpensive apparatus that can be installed and adapted to existing intersections with a minimum addition of electrical interconnections or mounting structures to those already present at the intersection, and which can be used in combination with existing traffic control systems to remotely control the operation of traffic light signals.

BRIEF DESCRIPTION OF THE INVENTION

The purpose of the present invention is to provide a satisfactory, inexpensive, and effective solution to the problem of emergency vehicles passing through busy intersections in a timely manner with the assurance that other vehicles and pedestrians at the intersection will be forewarned by means of an information warning display and a pre-empted traffic signal condition that an emergency vehicle is imminently approaching and therefore will stay clear of the passage of the approaching emergency vehicle.

The above purposes of the invention are realized by supplying infra-red data transmitters to emergency vehicles which signal the emergency vehicle's approach or egress to an intersection. Transmitters transmit an infra-red signal to receivers positioned at the intersection. Preferably there are a multiplicity of directional infra-red receivers each one of which will monitor the approach path or egress of an emergency vehicle upon a specific roadway crossing or entering the intersection. Additionally the intersection will be provided with a multiplicity of early warning informational display signs which will provide sufficient warning information to all vehicles and pedestrians in the vicinity of the intersection of the direction and road in which the vehicle is approaching. A master controlling system at the intersection receives the infra-red transmitted emergency vehicle data from the directional receiver and causes display signs to accurately portray the location and disposition of all approaching and egressing emergency vehicles in the vicinity of the intersection. This master control system is also connected to the usual traffic light control system at the intersection and transmits an electronic signal to cause the traffic lights to change to a desired pre-empted condition such as all red. This stops all traffic in the vicinity of the intersection until the emergency vehicle has passed. The usual traffic light control computer is locked in the pre-empted condition until the master controller pre-empt signal is overriden. Alternately, the preempted condition will automatically cease after a predetermined time interval subsequent to receiving infra-red data transmissions from an emergency vehicle and the receiver at the intersection.

The system is therefore comprised of one or more infrared transmitters mounted on the vehicle to indicate or transmit signals whenever the emergency vehicle is on a call. Infra-red receivers positioned at each intersection receive the transmitted signals at a predetermined range of up to approximately one thousand feet causing all the traffic signals at that intersection to turn red. The range of the IR transmitters and receivers should be sufficient to allow traffic to come to a complete halt well before the emergency vehicle enters the intersection so that it can be certain that it can safely proceed. The infra-red receiver communicates the information to a master control computer which also controls display signs providing information to vehicles and pedestrians approaching or already at the intersection. The early warning information display system provides a visual warning that an emergency vehicle is approaching but also symbolically indicates the direction from which the vehicle is approaching so that pedestrians and vehicles at the intersection can be alert and move out of the path of emergency vehicles. An optional feature would be also to provide some audible signal at the intersection to anyone at the intersection whose vision might be obstructed or impaired for any reason. This could be in addition to the audible siren with which emergency vehicles are equipped.

The above and other objects, advantages and novel features of the invention would be more fully understood from the following detailed description and the accompanying drawings, in which like reference numbers indicate like or similar parts throughout the drawings wherein:

DETAILED DESCRIPTION OF THE INVENTION

Figure 1:
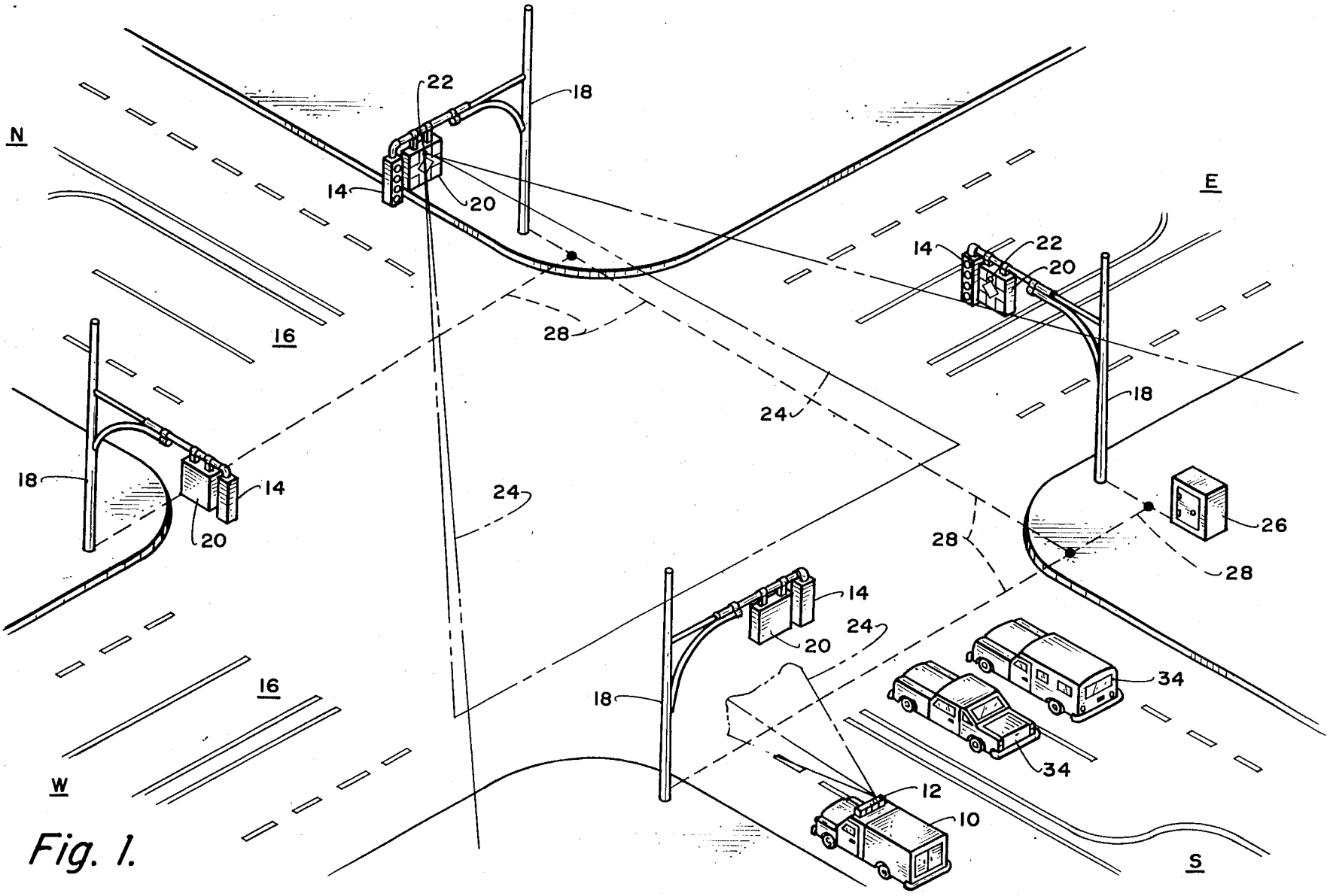
FIG. 1 illustrates an intersection equipped with the emergency vehicle early warning system according to the present invention.

Referring now to FIG. 1 an intersection having the emergency vehicle warning system installed according to the invention is illustrated. An emergency vehicle 10 having a transmitter 12 conveniently mounted on the vehicle approaches the intersection which has traffic signals 14 clearly visible to vehicles coming along lanes 16 on a typical cantilevered supports 18. Mounted alongside the usual traffic signals on the cantilevered support 18 are emergency vehicle warning displays which will be described in greater detail hereinafter. The displays are mounted in housing 20 which also supports receivers 22 for receiving a signal 24 from transmitter 12 mounted on the emergency vehicle 10. Preferably the receiver is electronic circuitry having an infra-red detector which is arranged for receiving infra-red energy in a receiver housing through an aperture of a Fresnel connecting lens (not shown). One or more silicon photo detectors are placed at the focal plane of the Fresnel connecting lens. Ambient light can be conveniently blocked by the use of an infra-red filter which will block light energy having wavelengths shorter than 0.85 Micrometers. The infra-red signal transmitted by transmitter 12 preferably has a wavelength centered at approximately 0.950 Micrometers. Physical size and placement of the infra-red photo detectors in the emergency warning display housings 20 depends upon the particular intersection in which they are used. However, preferably they are placed with respect to an optical axis of the Fresnel connection lens to define a field of view indicated by phantom lines 24 of the receiver optical system from zero degrees up, to 20 degrees down, 15 degrees left, and approximately 40 degrees right. Obviously the field of view of the detector can be enlarged and moved around by aiming the optical axis of the system in different directions.

The infra-red optical receiver as described previously is mounted in the warning information display device housing 20 and detects and demodulates the infra-red signal transmitted from the emergency vehicle 10 and stores this data in the vehicle status memory. A master controller module is located inside traffic control console or cabinet 26 located in the vicinity of the intersection. The master control module in the traffic control console 26 transmits a polling message to each of the receiver modules in sequence by means of carrier current data link 28 connecting each of the receiver modules to traffic signal control console 26. Data links 28 are the usual 110 volt A.C. power lines to display devices in housing 20. Whenever a particular receiver module receives a polling signal from the master controller the receiver module transmits via carrier current links 28, a message containing the data from its vehicle status memory to the master controller. The master controller receives the message from the active receiver module and indicates that an emergency vehicle is either approaching or departing from the roadway 16 within the field of view 24 of the respective receiver 22. The master controller in the traffic control console 26 is programmed to then send a predetermined pre-emptive control signal to the traffic light control system computer to change traffic signals 14 into a predetermined emergency condition to stop all traffic. While the predetermined emergency condition can be changed by altering the program residing in the traffic control computer it is preferable that the traffic signals all turn red.

The master controller in addition to pre-empting operation of the traffic signals 14 sends out display information to each one of the display devices in housing 20 to alter the displays according to the direction perceived of the emergency vehicle 10. Each display device 20 is programmed to determine from the nature of the signal received from the master controller its particular display so as to accurately indicate the position and direction of the emergency vehicle 10.

Figure 2:
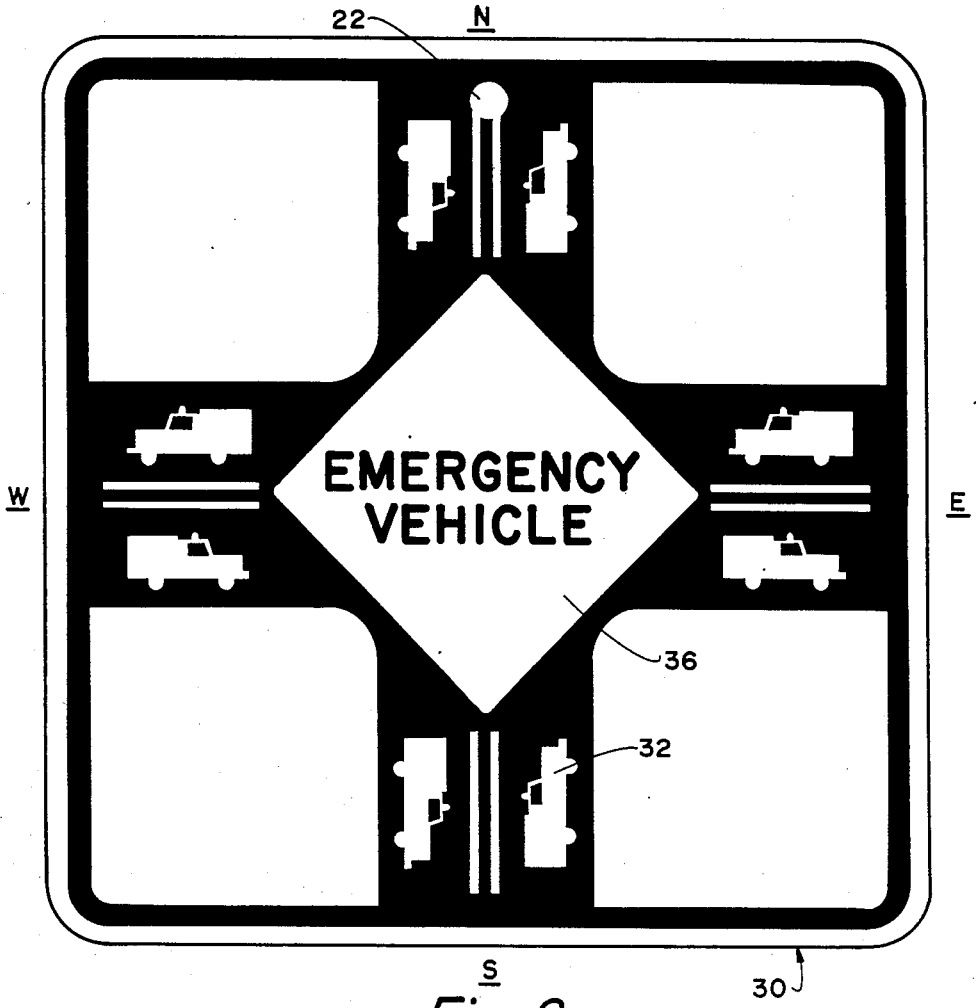
FIG. 2 illustrates an emergency vehicle display warning and information sign used in the system of FIG. 1.

An example of a suitable display panel for the display device in housing 20 is shown at 30 of FIG. 2. Presuming that the display shown in FIG. 2 is the display panel directly across from the emergency vehicle 10 symbolic displays 32 will illustrate the direction and approximate position of the emergency vehicle. For example symbolic display 32 would be illuminated indicating an emergency vehicle approaching directly across and moving in a direction toward a particular display panel 30. Likewise the display sign to the right of the emergency vehicle would indicate a vehicle approaching from its left. The other display signs would illuminate their symbolic displays accordingly. To better illustrate the display the intersection has been labeled N,S,E,W for the north, south, east and west directions and the display panel of FIG. 2 has likewise been labeled. Thus the display panel 20 facing the west would show the emergency vehicle approaching from the south or to the right of a vehicle heading eastbound. For example, as illustrated in FIG. 1 north display 20 would illustrate a vehicle coming from the south side of the intersection or a vehicle approaching from below while the display on the east side would show a vehicle approaching from the south side or to the right. The display on the west side facing eastbound lanes would show a vehicle also approaching from the side or from the operator's left. Thus the vehicles 34 shown at the intersection viewing the display sign at the north side of the intersection would see an emergency vehicle approaching from behind them or directly south, to their rear.

The master controller circuit which will be described in greater detail hereinafter will continue to poll each of the receiver modulars in the display sign housing 20 sequentially. When no further messages are detected indicating an emergency vehicle the master controller in the traffic signal control console 26 will send a command to the traffic control computer to return the traffic lights 14 at the intersection to normal operation.

In addition to the symbolic illustration on the direction of movement in operation of emergency vehicles the emergency warning display 30 also has a diamond illuminated portion 36 which illuminates the warning "Emergency Vehicle" to indicate to pedestrians and vehicles approaching or at the intersection that an emergency vehicle is imminently approaching the intersection. Optionally, the display system 20 could include an audible warning which would supplement the normal sirens and bells with which the emergency vehicle 10 is equipped.

Figure 3:
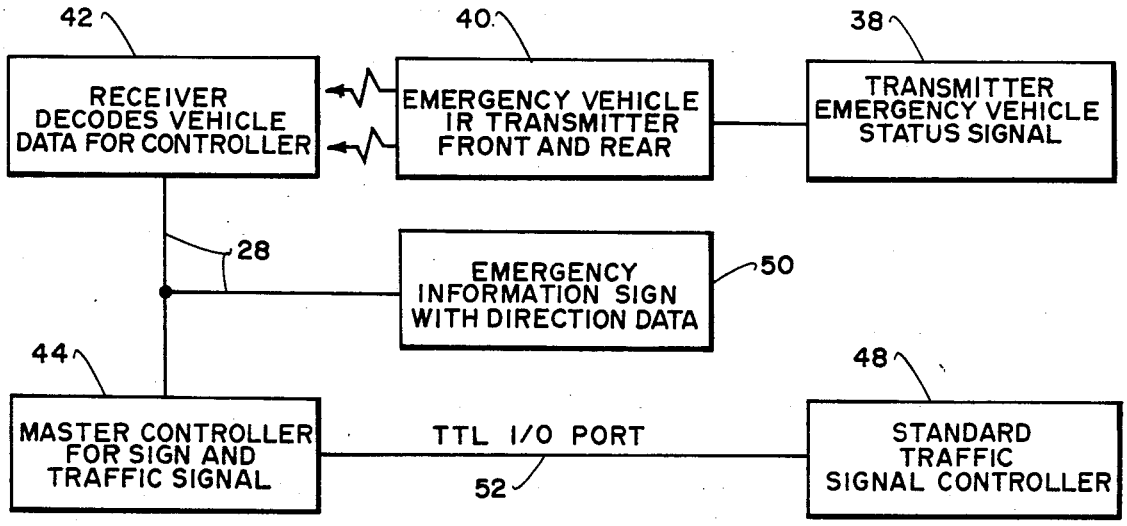
FIG. 3 is a functional block diagram illustrating the components of the invention.

A block diagram of the electronic circuits for the emergency vehicle warning system is illustrated in FIG. 3. Each emergency vehicle is equipped with an emergency vehicle infrared transmitter 40 mounted on the emergency vehicle. A transmitter status signal 38 indicates to the operator that the transmitter is functioning properly. Preferably the emergency vehicle is equipped with an IR transmitter housing with both front and rear transmissions to indicate approach or departure from the intersection. Receivers 42 receive the signal from the transmitters through IR detectors and provide an output to a master controller 44 mounted in the traffic control console 26 along with a standard traffic signal controller 48. Master controller 44 communicates with receiver 42 and emergency information display device 50 via data links 28. These data links use normal 110 VAC lines to these devices. Master controller 44 also communicates with the standard traffic controller in the traffic control signal console through I/0 port 52 by means of Transistor-Transistor Logic (TTL) signals. The signals from the master controller pre-empt the standard traffic signal controller whenever the presence of an emergency vehicle is detected.

The appearance, when visible, of emergency vehicle information/warning display is illustrated in FIG. 2. The display 30 is lit internally in display housing 20 and when off is not visible. When activated the background portions (i.e. white portions in the figure) will preferably appear to be a light yellow with the symbolic roadway intersections appearing black on a yellow field together with the black "emergency vehicle" legend. Eight possible emergency vehicle mode symbols are independently lit and preferably appear in a flashing yellow when lit and black when not illuminated. These vehicle mode symbols are configured to symbolically indicate the approach or departure of emergency vehicles along the four possible roadway directions. It is also well within the perceived objects of the invention to provide a display configuration for intersections which are not at right angles or which have more or less than four roadway directions.

Figure 4:
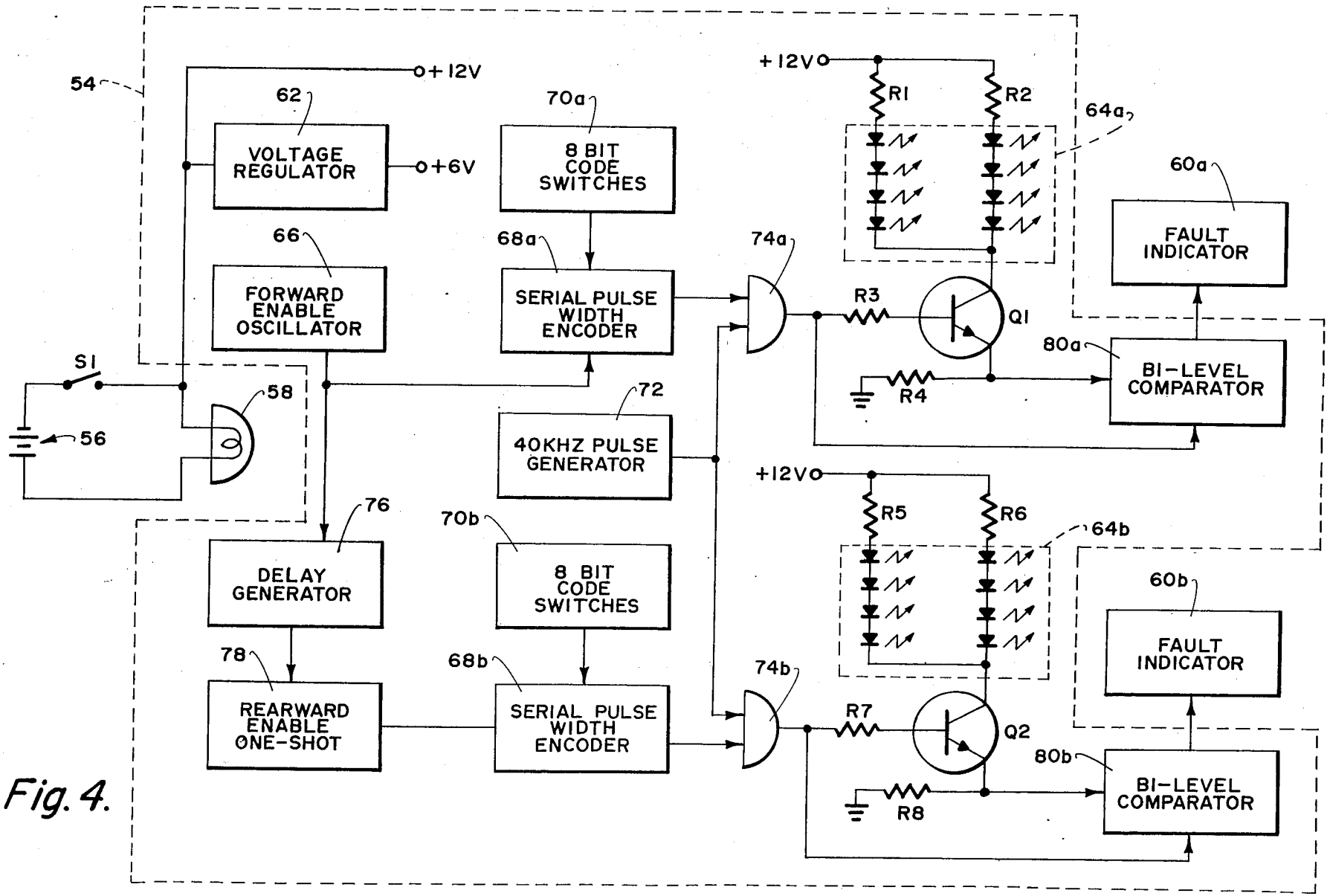
FIG. 4 is a semi-schematic block diagram of an emergency vehicle transmitter electronic circuit according to the invention.

A semi-schematic block diagram of an electronic circuit for a two channel transmitter is shown in FIG. 4. The circuit components within the dotted line 54 are located in a housing mounted on the roof or other convenient location on an emergency vehicle 10 (FIG. 1). The power for the transmitter of electronics is provided by vehicle battery 56 connected by switch S-1 located at some convenient location inside the cab or operator compartment of the emergency vehicle. Optionally switch S-1 could also function to activate the siren or other emergency signals. The transmitter circuit 54 is comprised of two channels, one for forward transmission whose components are indicated by the "a" attached to each reference numeral and the rearward transmitter whose components are indicated by the identical reference numeral with a "b". Each transmitter is equipped with fault indicators **60*a* and 60*b* which may also be located within the cab or operator compartment along with "on" indicator lamp 58. Power to the respective circuits is provided by voltage regulating circuit 62 which provides a 6 volt output to all the circuits. Diode arrays 64*a* and 64*b*** receive 12 volt power input directly from the vehicle battery.

Forward enable oscillator circuit 66 provides a voltage output which repetitively enables pulse width encoder **68*a* to turn on for a transmit period and then subsequently to turn off for a non-transmit or quiet period. During the transmit time interval forward serial pulse width encoder 68*a* provides a 10 bit serial code word comprised of two preamble bits and 8 data bits. The pulse width of each data bit of the 8 bit code is determined by switch settings of 8 bit code switches 70*a*** and 70*b*. An output pulse train is combined of the output of serial pulse width encoder 68*a* modulated by a 40 kHz output from 40 kilohertz pulse generator 72 in "AND" gate 74*a*. The modulated pulse train voltage source out of "AND" gate 74*a* provides base bias current for transistor Q1 through resistor R3 which results in Q1 driving pulses of current through infrared light emitting diode array 64*a*. Diode array 64*a* emits light pulses with optical power directly proportional to the magnitude of the current pulses in the modulated pulse train and identical to the output pulse train from "AND" gate 74*a*. At the completion of a transmitted code word forward pulse width encoder 68*a* is deactivated. While the forward pulse within encoder 68*a* is deactivated the rear transmitter circuits labeled with the substantially identical reference numerals and a "b" transmits its code word and then is off for a quiet period before repeating. The quiet non-transmit period is three times longer than the transmit period ,therefore it is possible for up to four emergency vehicles to be simultaneously transmitting without code words overlapping or interfering.

Delay generator 76 is activated when forward pulse width encoder 68*a* is enabled, and after the end of a forward code word, the delay generator triggers rear enable one shot multivibrator 78 which enables rear pulse width encoder 68*b* to produce a coded pulse train at its output. At the completion of the rear transmitted code word rear pulse width encoder is turned off and is not enabled until forward pulse width encoder 68*a* has transmitted another code word. The rear code pulse train is output through "AND" gate 74*b* to transistor Q2 and infrared light emmiting diode array 64*b*.

Pulse currents through each of diode arrays 64*a*, 64*b*, produce voltage signals at the respective emitter resistors R4 and R8. These voltage signals are proportional to the pulse currents and can be monitored with bi-level voltage comparators 80*a* and 80*b*. Base bias voltages at resistors R3 and R7 are used to derive reference voltages for bi-level comparators 80*a* and 80*b*. If any of the diodes in diode arrays 64*a* and 64*b* experience a failure, pulse voltages at resistors R4 and R8 will change to outside a normal range and bi-level comparators will produce an output which is stored in the memory of fault indicators 60*a* and 60*b*, and used to light fault indicators. The fault indicator light can be located remotely in the cab of the emergency vehicle which will enable the operator to instantly determine that his transmitters are not properly functioning.

Within the diode arrays 64*a* and 64*b* of the transmitters each diode has its optical axis individually aligned in different directions so as to provide a composite optical transmitting beam 24 of approximately 24 degrees right, 24 degrees left, zero degrees down and approximately 24 degrees up in the forward direction with the rearward transmitting diodes similarly disposed. The light emitting diodes of course would be arranged so that their transmitted energy could pass through clear windows mounted at the ends of a housing for transmitter 12 secured to emergency vehicle 10. The infra-red transmitting circuit would be constructed and mounted on an electronic circuit board which would also be mounted inside the same housing. Preferably any housing mounted on top of the vehicle would be hermetically sealed as protection in adverse weather conditions. As indicated previously the transmitter is turned on by switching on S-1 positioned inside the vehicle cab which may also control emergency lights or the siren. Monitoring circuits such as indicator light 58 and fault indicator 60*a* and 60*b* provide information to the operator of the emergency vehicles that the transmitters are properly operating or when a malfunction in a transmitter occurs.

Figure 5:
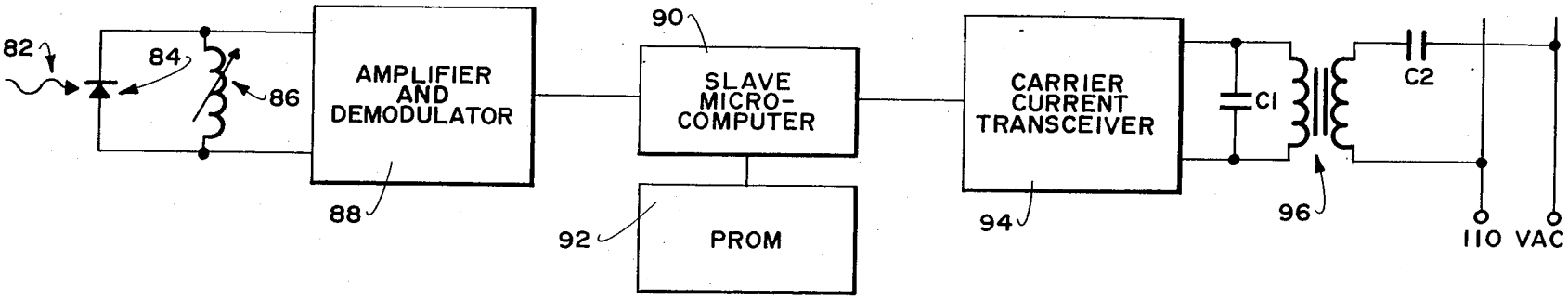
FIG. 5 is a semi-schematic block diagram of an infra-red receiver electronic circuit according to the invention.

The infra-red receiving electronic circuits is illustrated in the semi-schematic block diagram of FIG. 5. An infra-red transmitted signal 82 is received by silicon photovoltaic detector 84 which is tuned by inductor 86 to allow only signals modulated with a 40 kHz carrier to be detected by amplifier/demodulator circuit 88. Tuned photovoltaic detector 84 effectively eliminates DC signals coming from background solar radiation impinging on the detector and also discriminates against extraneous light signals in the vicinity of the detector. A detected signal is amplified and modulated by circuit 88 with the resulting serial data word read into slave micro-computer 90 and stored in a vehicle status memory according to software instructions residing in programmable read only memory (PROM) 92. Slave micro-computer 90 stores a decoded data word in its memory and upon being polled by the master controller subsequently transmits a message containing the data word. Slave micro-computer 90 will continue to re-transmit the message until the master controller acknowledges the message reception. At this time the particular slave micro-computer initiates a timing clock and returns to the task of monitoring and storing received infra-red (IR) data. At the end of the timing interval, slave micro-computer 90 stops monitoring IR data and waits for a polling request. The communication link is provided between master controller and slave micro-computer 90 by carrier current transceiver 94 which is coupled to the 110 VAC power line transmission link 28 by means of line coupling transformer 96.

The infra-red receiver digital process circuit reads a serial data word received from amplifier/demodulator circuit 88. A data word preferably consists of a "one", "zero", 2-bit preamble followed by 8 data bits which can be either "ones" or "zeroes". The system is configured so that the first data bit is used to define the transmitter direction. A "one" bit indicates forward transmissions in the direction the vehicle is travelling and therefore indicates an approaching emergency vehicle. Conversely, a "zero" bit indicates a departing or egressing rear transmitting vehicle. The remaining seven bits can be useful to provide error detection codes and for identifying particular emergency vehicles.

Numerous transmitting/receiving bit/coding schemes are possible. The preferred bit and coding scheme of the present invention utilizes a pulse width scheme for encoding "ones" and "zeroes". Each bit is composed of four time increments. A "zero" bit contains a transmitted signal for one increment followed by three increments of null (0) transmissions. A "one" bit contains a transmitted signal for three increments followed by one increment of null (0) transmissions. Therefore a "zero" bit has a width of one increment and a "one" bit has a width of three increments. Bits should be separated by at least one null increment. Slave micro-computer 90 reads input data signals and compares the pulse widths determined by sampling the data signals to a threshold interval set at two increments. If the pulse width exceeds two increments then the bit is decoded as a "one", otherwise it is decoded as a "zero". A decoded data word is compared by micro-computer 90 with a stored library of data words to determine if a correct message has been received. Whenever a proper 8 bit data word is decoded, the micro-computer stores that 8 bit byte of data for transmission to the master controller on the next polling cycle of the master controller module.

Figure 6:
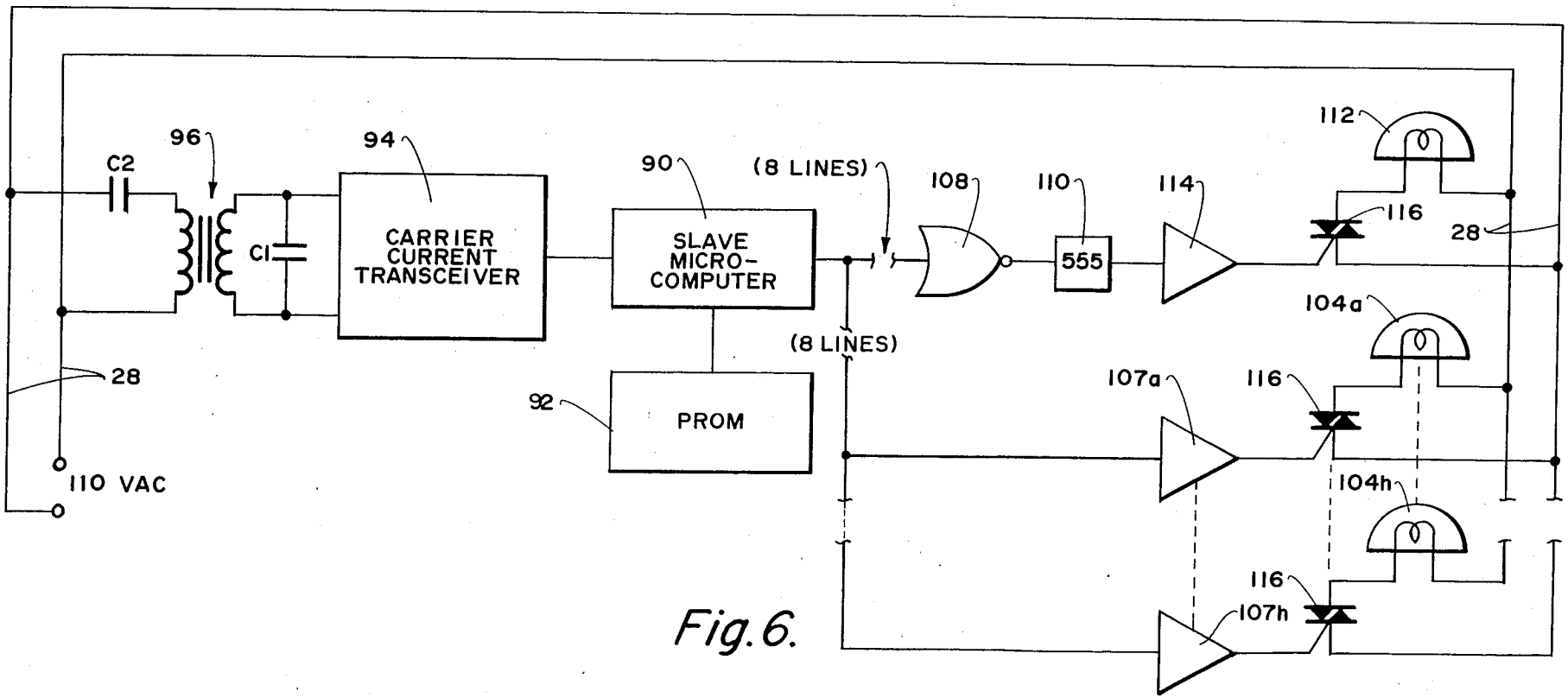
FIG. 6 is a semi-schematic block diagram of an emergency vehicle warning information display electronic circuit according to the invention.

A block diagram of the electronics for the display warning sign is shown in FIG. 6. The display module consists of the same carrier current transceiver 94, data link 28, slave micro-computer 90 and from 92 used by the infrared receiver with drive circuitry to control the background illumination of the display and flashing of the emergency vehicle symbols on the display panel.

A display configuration message is sent to display slave microcomputer 90 via 110 volt A.C. power line transmission data link 28 and is received via carrier current transceiver 94 and decoded by micro-computer 90. Display slave micro-computer 90 is also used for reading and storing received IR data. Whenever the slave micro-computer 90 is polled to determine the emergency vehicle status, the polling request contains an 8 bit data field that establishes the configuration of the display panel. Each bit controls the level of 8 independent output ports which in turn control indicator lights 104*a*–104*h* of the display isolated by buffers 107*a*–*107h* to indicate or illuminate one of the mode symbols on each display panel to indicate the 8 bit configuration data as latched into the output port of microcomputer 90. If the data is non-zero a timing cycle function is evoked by software conveyance and lights representing an emergency vehicle disposition are flashed.

The 8 output lines from slave micro-computer 90 are combined in NOR logic gate 108 and if any of the eight output are non-zero, NOR logic gate 108 provides an output trigger to 555 timer 110 which turns on background lights 112 isolated from the circuit by buffer 114. The background will remain on for a predetermined period of time after all the output lines have been set to zero.

The lights receive power from the 110 volt A.C. power line and are controlled by triac control circuits 116. Triac control circuits 116 are controlled from low level circuitry through buffer opto-isolator drivers 107*a*–107*h*,114.

Figure 7:
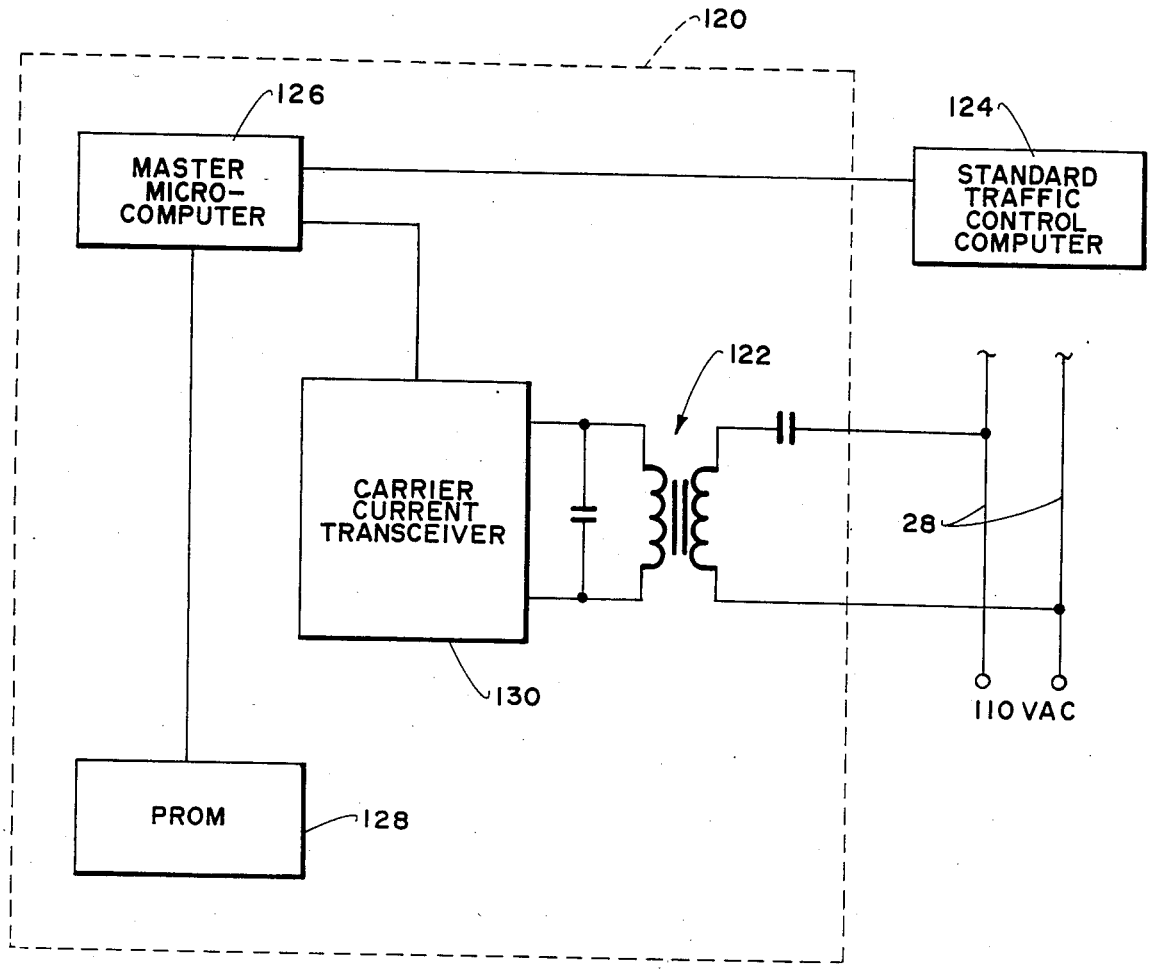
FIG. 7 is a block diagram of an master controller electronic circuit according to the invention.

Master controller 120 is mounted within traffic light controller console 26 located in the vicinity of the traffic intersection and is shown in semi-schematic form in FIG. 7. Master controller circuits are contained in a housing 120 mounted in the traffic controller console and are connected to the 110 volt A.C. power cable data link 28 via carrier current transceiver 130 and coupling transformer 122 and to standard traffic control computer 124 through a direct wire from micro-computer 126. Micro-computer 126 receives its operating instructions from software programs stored in programmable read only memory (PROM) 128. Master controller micro-computer 126 transmits polling requests sequentially to each slave micro-computer 90 located in the housing of the warning/information display device. When polled each slave micro-computer 90 transmits to master micro-computer 126 via carrier current transceiver 94, data link 28, and transceiver 130 the contents of its vehicle code status memory, which is either a null or a detected vehicle code word and infra-red receiver location. The master controller micro-computer 126 formats this data into a display configuration message and transmits it to each slave micro-computer 90 on the next polling cycle. Each display 20 is updated once each polling cycle. Master controller micro-computer 126 and slave micro-computer 90 may, for example, be a National Semiconductor COP402N or equivalent integrated circuit.

In addition to sending out display configuration messages, master micro-computer 126 sends a pre-emptive signal to standard traffic control computer 124 whenever a vehicle code word is received from any slave micro-computer. The pre-emptive signal will cause traffic control computer 124 to enter into a predetermined emergency signal condition for the intersection. For example, preferably, the traffic lights may all be sequenced into an all red condition. This stops all traffic from entering or proceeding through the intersection clearing the way for emergency vehicles. It is possible with the circuits described to invoke any predetermined traffic signal condition by providing an appropriate software program for traffic control computer 124.

Thus there has been described a novel and unique emergency vehicle warning system having a display that indicates the location and direction of travel of emergency vehicles approaching an intersection. Additionally, the emergency vehicle warning system pre-empts control of all traffic signals in the area of the intersection and stops all traffic. This allows emergency vehicles to proceed rapidly with relative safety through the intersection. This is particularly useful in situations in which police cars may be pursuing a suspect. The suspect usually disregards cross traffic in intersections in his attempts to escape. However, police vehicles must exercise some caution and slow down at intersections or even abandon the pursuit. With a device as shown in the present invention safety could be considerably increased by activating all traffic signals to a red condition well ahead of the pursuing vehicle and perhaps even ahead of the vehicle being pursued.

This invention is not to be limited by the embodiment shown in the drawings and described in the description which is given by way of example and not of limitation but only in accordance with the scope of the appended claims.

What is claimed is:

1. An emergency vehicle warnng and traffic control system comprising;

dual channel transmitting means having one channel constructed to transmit a code indicating the approach of an emergency vehicle to an intersection, the other channel constructed to transmit a code indicating the departure of an emergency vehicle from an intersection;

means mounting said dual channel transmitting means on an emergency vehicle;

a plurality of directional receiving means mounted at a traffic intersection in the path of said emergency vehicle;

signal processing means receiving and processing the outputs from said plurality of directional receiving means;

coupling means coupling said signal processing means to a traffic control system at said intersection;

said signal processing means pre-emptying said traffice control system to control the flow of all traffic through said intersection;

display means mounted at said intersection, said display means constructed and arranged to indicate the proximity and direction of travel of an approaching or departing emergency vehicle;

connecting means connecting said signal processing means to said display means for activating said display when a signal is received from said plurality of directional receiving means whereby information about an approaching or departing emergency vehicle is displayed.

2. The system according to claim 1 in which said dual channel transmitting means and said plurality of receiving means transmit and receive in the infra-red wavelength range.

3. The system according to claim 2 in which said dual channel transmitting means emits infrared energy in the wavelength range of 0.8 to 1.0 micrometers and said receiver means is comprised of silicon photovoltaic detectors operating in a range of 0.8 micrometers to 1.0 micrometers wavelength.

4. The system according to claim 3 in which said silicon photovoltaic detectors operate at a wavelength centered approximately at 0.950 micrometers.

5. The system according to claim 3 including means for blocking light energy with wavelengths shorter than approximately 0.85 micrometer.

6. The system according to claim 1 in which said directional receiving means is mounted facing oncoming traffic with there being a directional receiving means for each roadway entering said intersection.

7. The system according to claim 6 in which said display means comprises;

housing means;

display panel means mounted on said housing means facing oncoming traffic, said display panel means constructed and arranged to provide early warning information as to the position and direction of travel of an emergency vehicle.

8. The system according to claim 7 in which said display panel has a plurality of symbols representing emergency vehicles upon each roadway and means for illuminating one or more of said symbols when an emergency vehicle is within a predetermined range of said intersection.

9. The system according to claim 8 in which said display panel means includes means warning of the proximity of an emergency vehicle to an intersection.

10. The system according to claim 9 in which said directional receiving means is mounted in said housing means for said display panel.

11. The system according to claim 1 in which said dual channel transmitting means includes forward transmitting means and rearward transmitting means whereby said display means responds to and indicates the approach or departure of an emergency vehicle to or from an intersection 12. The system according to claim 1 in which said signal processor means comprises master controller means, said master controller means being mounted in a traffic light control console in the vicinity of said intersection.

13. The system according to claim 12 including means connecting said master controller means to each representative directional receiving means mounted at an intersection.

14. The system according to claim 13 in which said master controller means receives an input from each of said receiver means at a predetermined rate, said master controller being programmed to respond to the receiving means receiving a signal from an emergency vehicle and producing a response to control said display panel means to display a symbol indicating the proximity and direction of travel of said emergency vehicle.

15. The system according to claim 14 including means connecting said master controller to an existing traffic light control computer mounted in said traffic light control console; said master controller programmed to pre-empt operation of said traffic control lights.

16. The system according to claim 15 in which said master controller is programmed to turn all traffic control signals red upon the approach of an emergency vehicle thereby stopping the flow of all traffic through said intersection.

17. The system according to claim 16 in which said master controller is connected to said directional receiving means and said display means through existing power lines.

18. The system according to claim 17 in which said master controller and receiving means operate in said existing power lines with carrier current transceivers.

19. The system according to claim 15 in which said master controller includes programming means programmed to vary the control of the traffic signals in a predetermined manner; said programming means comprising a software program in said master controller.

* * * * *